US006164494A

United States Patent [19]

Marelli

[11] Patent Number: 6,164,494

[45] Date of Patent: Dec. 26, 2000

[54] LIQUID DOSE DISPENSER WITH DEVICE FOR COUNTING A LARGE NUMBER OF DISPENSED DOSES

[75] Inventor: Andrea Marelli, Rozzano, Italy

[73] Assignee: Microsrpray Delta S.p.A., Fizzonasco di Pieve Emanuele, Italy

[21] Appl. No.: 09/523,722

[22] Filed: Mar. 13, 2000

[30] Foreign Application Priority Data

Jun. 30, 1999 [IT] Italy ..... MI99A1448

[51] Int. Cl.[7] ..... B67D 5/22

[52] U.S. Cl. ..... 222/38; 222/36

[58] Field of Search ..... 222/36, 38, 321.6, 222/321.9

[56] References Cited

U.S. PATENT DOCUMENTS

| | | | |
|---|---|---|---|
| 4,565,302 | 1/1986 | Dreiffer et al. | 222/38 |
| 5,174,473 | 12/1992 | Marelli | 222/38 |
| 5,228,586 | 7/1993 | Fuchs | 222/38 |

*Primary Examiner*—Kevin Shaver
*Assistant Examiner*—Thach H. Bui
*Attorney, Agent, or Firm*—Oblon, Spivak, McClelland, Maier & Neustadt, P.C.

[57] ABSTRACT

A dispenser for measured quantities of a liquid product delivered under pressure by a metering pump or valve on which the dispenser is fitted, the dispenser having a device comprising discs on which there are reproduced two separate progressive successions of numbers which are selectively visible through a window in the dispenser, firstly the numbers of one disc and then the numbers of the other, to count the doses dispensed.

3 Claims, 3 Drawing Sheets

LIQUID DOSE DISPENSER WITH DEVICE FOR COUNTING A LARGE NUMBER OF DISPENSED DOSES

This invention relates to a dispenser for dispensing measured quantities of a liquid, provided with a device for counting a large number of dispensed doses.

Many liquids, in particular pharmaceutical substances, are dispensed in measured quantities which have to be counted, each dose being dispensed by manually operating a dispenser applied to the stem of a pump or dispensing valve mounted on the mouth of a container containing the liquid to be used.

Liquid dose dispensers provided with devices for counting the number of doses already dispensed are described in the literature, for example in EP-B-114617, EP-B-269496, EP-A-472915 and EP-B-480488.

The device for counting the number of doses dispensed by the dispensers covered by the aforesaid patents comprises a discoidal body mounted rotatable about the longitudinal axis of the respective dispenser and having a continuous succession of numbers (increasing from 1 to about 20) reproduced along the periphery of the discoidal body, which is rotated through one step each time the dispenser is operated. One number at a time (in the increasing direction) is visible through a window provided in the dispenser, so making it possible to count the number of doses dispensed.

Known dispensers with a counting device have only one discoidal body. As these discoidal bodies are necessarily of small dimensions, the numbers reproduced along their periphery are necessary limited in quantity, in general to about twenty. This means that dispensers of known type enable only a relatively small number of dispensed doses to be counted, thus limiting their application to small-volume liquid containers able to contain a liquid quantity equivalent to about twenty individual doses.

The main object of the invention is to provide a liquid dose dispenser having a device which enables a number of dispensed doses to be counted which is much larger (at least about double) than that achievable with similar known dispensers.

A further object is to provide a dispenser of the aforestated type which is of simple structure, low production cost and reliable operation.

These and further objects are attained by a dispenser comprising:

a base body with a seat for housing the free end of a pump or valve for delivering doses of a liquid contained in a container on which the pump is mounted;

an operating body superposed on the base body and secured to it by guide elements which allow axial movement, but prevent rotation, of one body on the other, the operating body having a substantially cylindrical wall in which a window or aperture is provided, and a top wall with a hole about which there extends a tubular element having at one end a seat for the free end of the pump stem and at its other end a nozzle for discharging the liquid dispensed by the dispenser;

a first discoidal body housed in and rotatable within the operating body and having a substantially cylindrical surface facing the surface of the lateral wall of the operating body, through the window of which there is selectively positioned one of a first succession of numbers, letters or the like reproduced on the cylindrical surface of the first discoidal body;

two sawtooth-shaped annular surfaces provided one on the base body and the other on the top wall of the operating body, the teeth of one of the two surfaces pointing towards the teeth of the other surface;

flexible tangs projecting from the first discoidal body, and having their profiled free ends engaging the toothed surface of the base body and toothed surface of the operating body respectively, to cause the first discoidal body to rotate through one step each time the operating body is moved axially relative to the base body, with consequent initial flexure of said tangs and their subsequent return to an unflexed rest position; characterised by also comprising a second discoidal body housed between the top wall of the operating body and the first discoidal body, and having a cylindrical lateral wall on which a second succession of numbers is reproduced, and which extends between and is rotatable between the lateral wall of the operating body and the cylindrical surface of the first discoidal body, on the operating body and on the first discoidal body there being provided retention members which mutually cooperate to transiently maintain a window provided in the lateral wall of the second discoidal body facing the window in the operating body, the first discoidal body having a drive tooth which, when said first body has undergone a complete revolution about its axis, interferes with a tooth provided on the second discoidal body to drag it into rotation, to disengage said retention members and position in succession one of the numbers of said second succession of numbers in front of the window in the operating body.

Preferably said retention members comprise a first projection provided on the inside of the top wall of the operating body and bounded laterally by an inclined surface on which there rests a flexible tang projecting from the second discoidal body, this projection being overcome, with the flexing of said tang, when the drive tooth of the first discoidal body moves the second discoidal body away from its rest position.

Again preferably, said first projection in the form of a sawtooth is flanked by a stop tooth on which the flexible tang of the second discoidal body rests to block the movement of this latter after it has undergone a complete revolution about its axis.

The structure and operation of the dose dispenser of the invention will be more apparent from the description of a preferred embodiment thereof given hereinafter by way of non-limiting example with reference to the accompanying drawings, on which:

Figure 1:
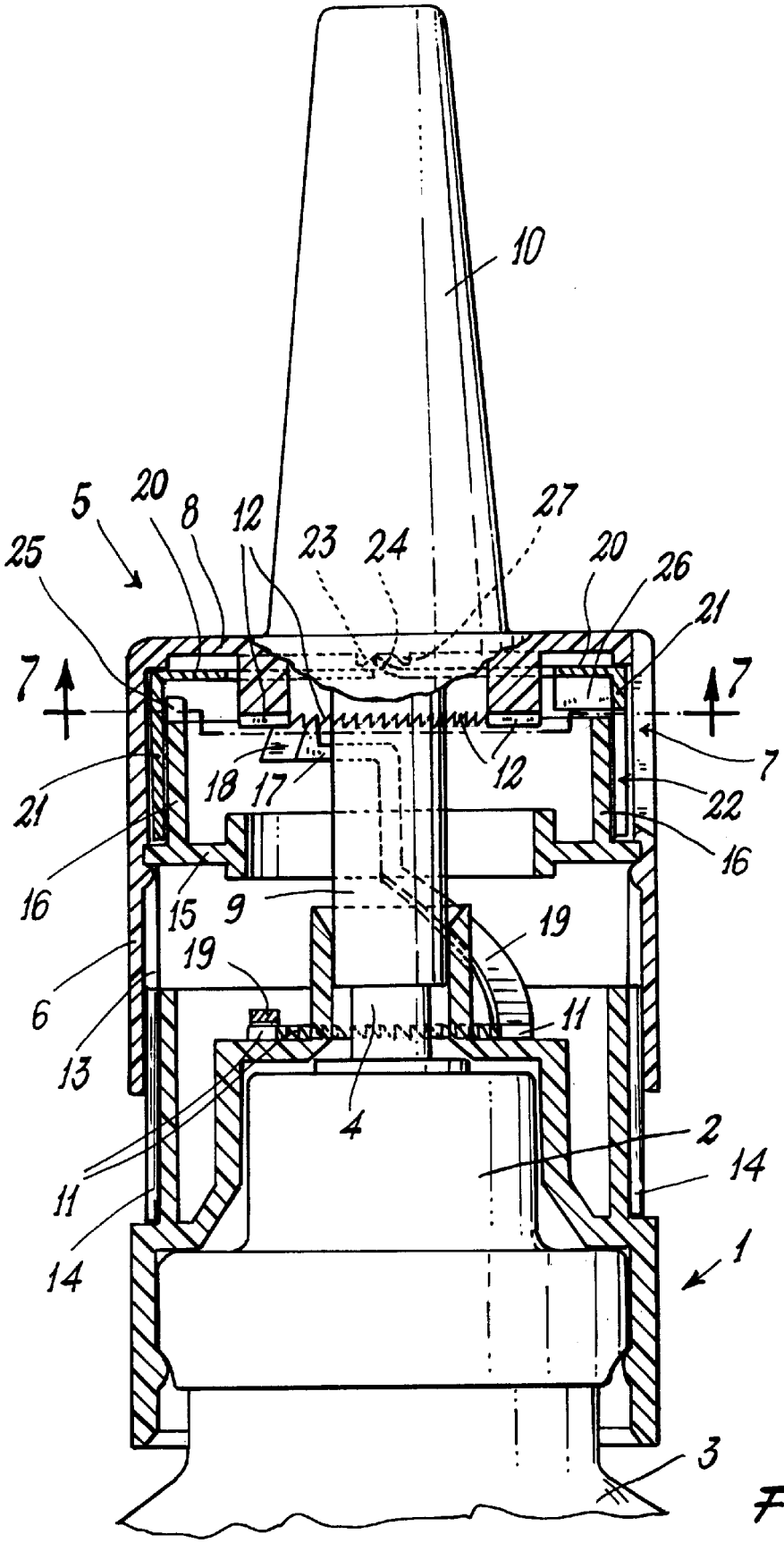
FIG. 1 is a partial axial section through the dose dispenser to an enlarged scale.
Figure 5:
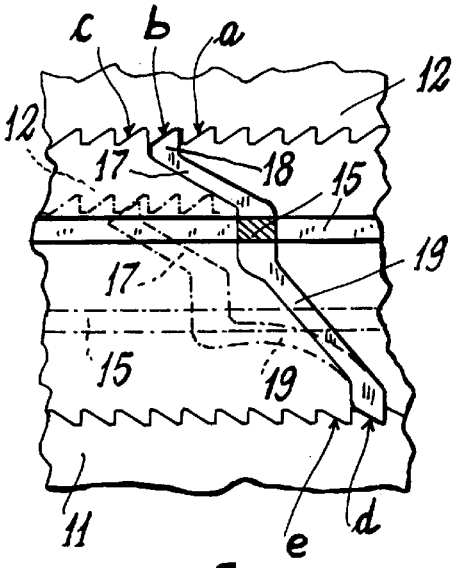
Figure 6:
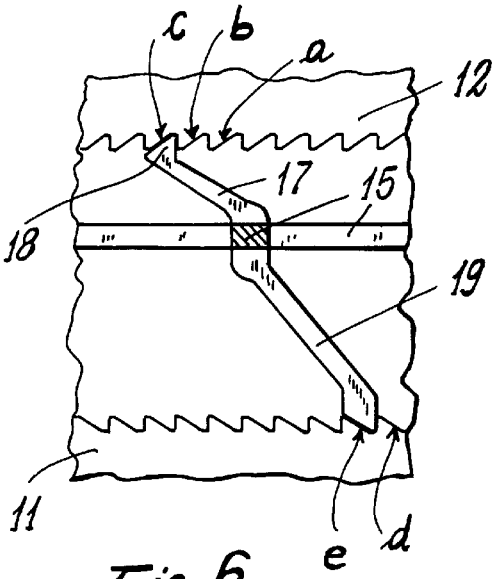
Figure 7:
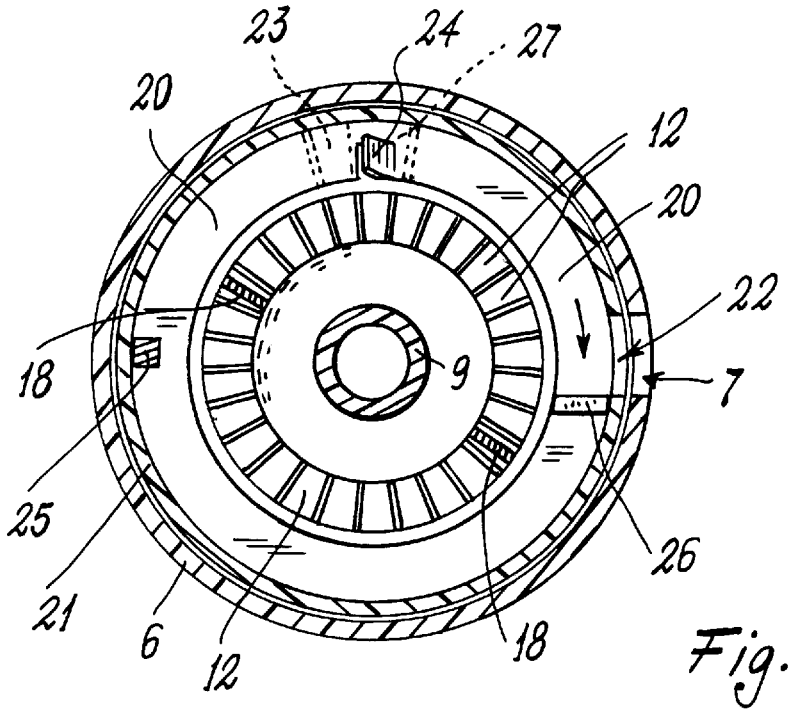
Figure 8:
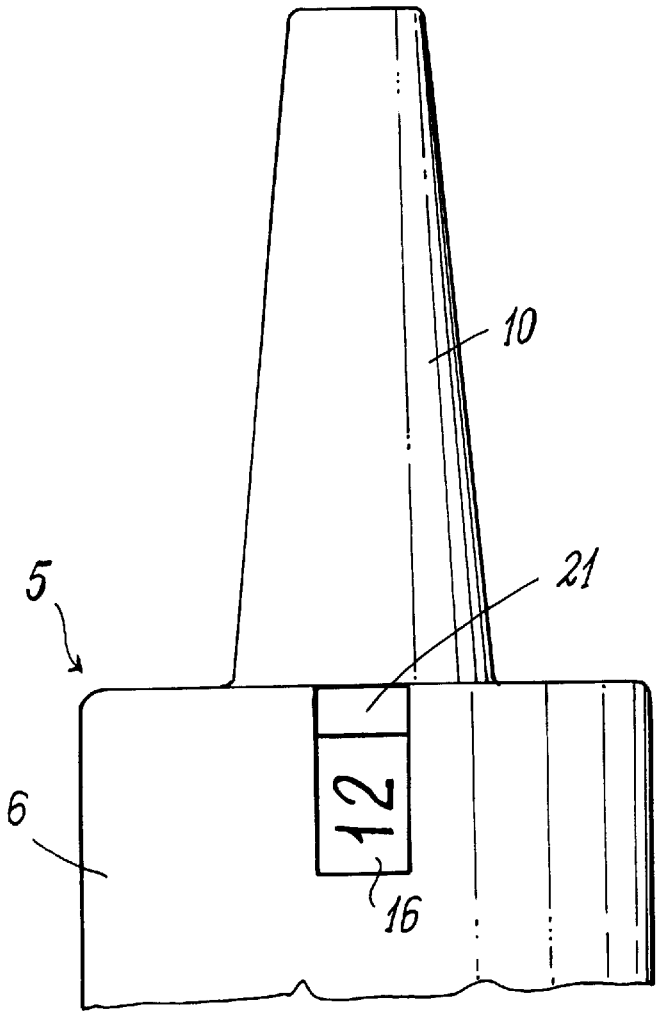

FIGS. 5 and 6 schematically represent an inner portion of the dispenser in various positions assumed during dispenser operation;

FIG. 7 is a cross-section through the dispenser on the line 7—7 of FIG. 1; and FIG. 8 is a partial side view of the dispenser.

Reference will firstly be made to FIG. 1, which shows a liquid dose dispenser comprising a base body 1 defining a seat for receiving and retaining the free end of a metering pump or valve 2 applied to the mouth of a container 3 containing the liquid to be delivered through the pump stem 4.

Onto the base body 1 there is fitted a operating body 5 having a cylindrical lateral wall 6 (in which a window or aperture 7 is provided) and a top wall 8 traversed by a hole (not visible on the drawing) about which there extends a tube, of which the downwardly facing portion 9 presents a seat into which the free end of the pump stem is inserted and retained, and the portion 10 extending outwards from the dispenser presents a nozzle (not shown) through which the dose of liquid originating from the pump is dispensed in atomized form. In the embodiment of FIG. 1, the tube portion 10 has the elongate tapering form of a nasal insert used for spraying doses of a pharmaceutical product into a person's nostrils.

From the base body 1 there projects upwards (with reference to FIG. 1) a succession of sawteeth 11 distributed in the manner of an annular surface. A similar succession of sawteeth 12, also distributed in the manner of an annular surface, projects from the top wall 8 of the operating body 5, the individual teeth of the two successions of teeth pointing towards each other.

Finally it should be noted that the two bodies 1 and 5 are connected together by a series of longitudinal grooves 13 and respective longitudinal ribs 14 inserted into and slidable within these grooves, to enable one body to move axially on the other, while preventing them from rotating relative to each other.

In the space delimited by the two bodies 1 and 5 there is housed a first discoidal body 15 having a cylindrical wall 16, on the outer surface of which there is reproduced a first continuous succession of numbers (in the case shown on the drawings the numbers extend from 1 to 24) which are visible selectively, one at a time, through the window 7.

From the top of the discoidal body 15 there projects a pair of flexible tangs 17 the free ends of which are shaped as a sawtooth 18 which engages the teeth of the ring of teeth 12. The inclined surface of each tooth 18 of the tangs 17 is in contact with, and can slide (hence causing the tang to flex) along, the inclined surface of the teeth 12 (so enabling the body 15 to rotate relative to the body 5), and jump over these teeth. The other surface of the tooth 18 and that surface of the teeth 12 which faces it are shaped to mutually interfere, and prevent rotation of the body 15 in the opposite direction to the preceding.

Likewise, from the bottom of the discoidal body 15 there projects a pair of flexible tangs 19, the free ends of which each extend between two consecutive teeth of the ring of teeth 11, sliding on their inclined surfaces when the body 15 is rotated in one direction, while jamming against the straight surfaces of these teeth to prevent rotation of the body 15 in the opposite direction.

To better understand how the discoidal body 15 is made to rotate through one step each time the dispenser is operated, reference will be made to FIGS. 5 and 6, which show schematically the developments of the teeth 11 and 12, between which there is also shown schematically a portion of the discoidal body 15 with a flexible tang 17 and a flexible tang 19.

When in the rest state the aforesaid component parts assume the position shown by full lines in FIG. 5.

When the operating body is pressed towards the base body to operate the pump and dispense a dose of liquid, the toothing 12 approaches the toothing 11 until it attains the position shown by dashed lines in FIG. 5. During this approach, the profiled end of the tang 19 remains locked on that tooth indicated by the letter d, whereas the tang 17 flexes to rotate the body 15 towards the left (with reference to the figure) through one step, and with it the tang 17, the profiled end 18 of which jumps over the inclined surface of that tooth indicated by the letter b in the toothing 12, and becomes positioned between the teeth b and c, as shown by dashed lines in FIG. 5.

When the pressure exerted by the two fingers on the top of the operating body 5 ceases, this latter is returned to its raised position by the action of the pump spring. However the profiled end 18 of the tang 17 remains fixed at the tooth b, between the two teeth b and c, to hence prevent the return of the discoidal body to that angular position which it had prior to the operation of the dispenser. While the toothing 12 returns to its rest position raised from the toothing 11 (FIG. 6), the profiled end of the tang 19 is dragged to jump over the inclined surface of the tooth d and become positioned between the teeth d and e.

The cycle can be repeated in this manner, with the window 7 each time showing the next number in the succession of numbers reproduced on the cylindrical surface 16 of the body 15, so enabling the number of dispensed liquid doses to be counted.

The dispenser with dose counter as described up to this point is similar to that described in EP-B-480488, in which the number of dispensed liquid doses which can be counted is equal to the highest number reproduced on the outer surface of the cylindrical wall 16 of the first rotatable body. In the case illustrated here this first body enables a maximum number of 24 doses to be counted.

The dispenser of the present invention comprises however a second discoidal body formed with a top annular wall 20 and a cylindrical lateral wall 21 which extends between and is rotatable between the lateral wall 6 of the operating body 5 and the cylindrical wall 16 of the first discoidal body (FIG. 1), the top wall 20 being positioned between and rotatable between the wall 8 of the body 5 and the first discoidal body 15, 16.

In the cylindrical wall 21 there is provided a window 22 which can be transiently retained facing the window 7 of the body 5 by the retention members described hereinafter. On the outer surface of said cylindrical wall 22 there is reproduced a second succession of increasing numbers the lowest of which, in the example shown here, is the number 25, ie one more than the highest number reproduced on the first discoidal body.

The dispenser is mounted such that before dispensing the first dose of liquid, the window 22 is positioned in front of the window 7, and through this the lowest (0 or 1) of the numbers of that series of numbers reproduced on the wall 16 is visible.

To prevent the second discoidal body 20, 21 from being dragged into rotation by the first body 15, 16 while dispensing the first series of liquid doses, retention members are provided consisting of a tooth or projection 23 projecting downwards (with reference to FIG. 1) from the top wall 8 of the body 5, this tooth or projection being bounded on one side by an inclined surface on which there rests the free end of an upwardly curved flexible tang 24 formed by cutting it from the annular wall 20. The friction exerted by the first discoidal body 15, 16 on the second discoidal body 20, 21 is insufficient to cause the tang 24 to flex and its free end to rise along the inclined surface of the tooth 23, so that the second discoidal body remains at rest while the first discoidal body undergoes a complete revolution about its axis, allowing all the numbers (in our case from 1 to 24) reproduced on the cylindrical wall 16 to be seen through the windows 7 and 22.

As can be seen from FIG. 1 and more clearly from FIG. 2, from the cylindrical wall 16 of the first discoidal body there projects a drive tooth 25 which, on termination of a complete revolution of this first body about its axis, interferes with a tooth or small rib 26 projecting below the wall 20 of the second discoidal body, which is dragged into rotation (causing the flexible tang 24 to jump over the retention tooth 23) by the first discoidal body, in step with it.

If it is required for the two discoidal bodies not to be able to undergo further rotation on termination of a complete revolution of the second discoidal body, adjacent to the tooth 23 a stop tooth 27 can be provided having a surface which the tang 24 cannot jump over.

It can be seen that as soon as the second discoidal body is dragged to undergo its first advancement step, the window 22 is moved away from the window 7 from which only the outer surface of the cylindrical wall 21 of the second discoidal body will then be visible (this hiding the cylindrical wall 16 of the first discoidal body from view), with the numbers (one at a time in succession) reproduced on it.

Figure 4:
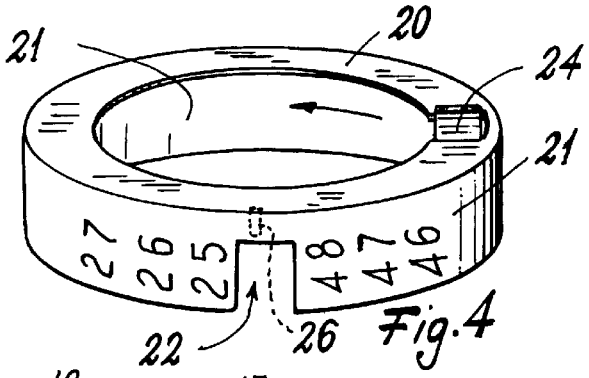
FIG. 4 is a perspective side view of the second annular body of the dispenser.
Figure 2:
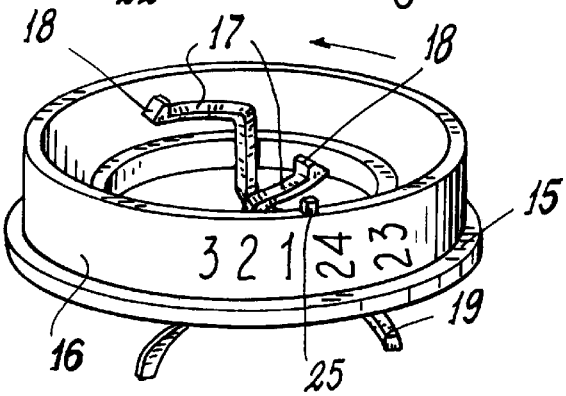
FIGS. 2 and 3 are respectively a perspective side view and a plan view of the first annular body forming part of the dispenser.
Figure 3:
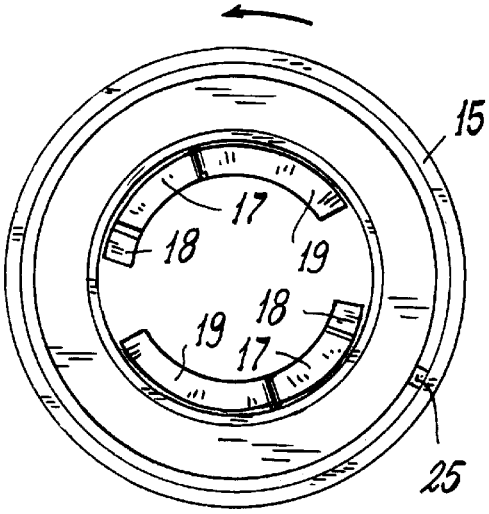

FIGS. 2 and 3 show the first discoidal body in perspective view and in plan view from above, whereas FIG. 4 shows the second discoidal body only in perspective view.

FIG. 7 is a cross-section through the device on the line 7—7 of FIG. 1 to facilitate the understanding of the dispenser structure and operation, no further explanation being necessary.

It is important to note that the dimensions of the device described and claimed herein are totally comparable to those of the device having a single rotatable discoidal body (EP-B-480488) while enabling twice the number of dispensed liquid doses to be counted.

What is claimed is:

1. A liquid dose dispenser with a device for counting the dispensed doses, comprising:

a base body with a seat for housing the free end of a pump or valve for delivering doses of a liquid contained in a container on which the pump is mounted;

an operating body superposed on the base body and secured to it by guide elements which allow axial movement, but prevent rotation, of one body on the other, the operating body having a substantially cylindrical wall in which a window or aperture is provided, and a top wall with a hole about which there extends a tubular element having at one end a seat for the free end of the pump stem and at its other end a nozzle for discharging the liquid dispensed by the dispenser;

a first discoidal body housed in and rotatable within the operating body and having a substantially cylindrical surface facing the surface of the lateral wall of the operating body, through the window of which there is selectively positioned one of a first succession of numbers or letters reproduced on the cylindrical surface of the first discoidal body;

two sawtooth-shaped annular surfaces provided one on the base body and the other on the top wall of the operating body, the teeth of one of the two surfaces pointing towards the teeth of the other surface;

flexible tangs projecting from the first discoidal body, and having their profiled free ends engaging the toothed surface of the base body and toothed surface of the operating body respectively, to cause the first discoidal body to rotate through one step each time the operating body is moved axially relative to the base body, with consequent initial flexure of said tangs and their subsequent return to an unflexed rest position; and a second discoidal body housed between the top wall of the operating body and the first discoidal body, and having a cylindrical lateral wall on which a second succession of numbers is reproduced, and which extends between and is rotatable between the lateral wall of the operating body and the cylindrical surface of the first discoidal body, on the operating body and on the first discoidal body there being provided retention members which mutually cooperate to transiently maintain a window provided in the lateral wall of the second discoidal body facing the window in the operating body, the first discoidal body having a drive tooth which, when said first body has undergone a complete revolution about its axis, interferes with a tooth provided on the second discoidal body to drag it into rotation, to disengage said retention members and position in succession one of the numbers of said second succession of numbers in front of the window in the operating body.

2. A device as claimed in claim 1, wherein said retention members comprise a first projection provided on the inside of the top wall of the operating body and bounded laterally by an inclined surface on which there rests a flexible tang projecting from the second discoidal body, this projection being overcome, with the flexing of said tang, when the drive tooth of the first discoidal body moves the second discoidal body away from its rest position.

3. A device as claimed in claim 2, wherein said first projection in the form of a sawtooth is flanked by a stop tooth on which the flexible tang of the second discoidal body rests to block the movement of this latter after it has undergone a complete revolution about its axis.

* * * * *

UNITED STATES PATENT AND TRADEMARK OFFICE

CERTIFICATE OF CORRECTION

PATENT NO. : 6,164,494

DATED : December 26, 2000

INVENTOR(S): Andrea MARELLI

It is certified that an error appears in the above-identified patent and that said Letters Patent is hereby corrected as shown below:

On the Title page, Item [73] , the Assignee information is incorrect. Item [73] should read as follows:

-- [73] Microspray Delta S.p.A., Fizzonasco di Pieve Emanuele, Italy

Signed and Sealed this

First Day of May, 2001

*Attest:*

Nicholas P. Godici

NICHOLAS P. GODICI

*Attesting Officer*

*Acting Director of the United States Patent and Trademark Office*